United States Patent [19]

Miyake

[11] Patent Number: 5,042,793

[45] Date of Patent: Aug. 27, 1991

[54] SHEET SORTER IMAGE FORMING APPARATUS HAVING SAME

[75] Inventor: Norifumi Miyake, Kawasaki, Japan

[73] Assignee: Canon Kabushiki Kaisha, Tokyo, Japan

[21] Appl. No.: 528,065

[22] Filed: May 24, 1990

[30] Foreign Application Priority Data

May 25, 1989 [JP] Japan ..... 1-133288

[51] Int. Cl.[5] ..... B65H 39/10

[52] U.S. Cl. ..... 271/293; 271/294; 414/926; 209/655; 209/706; 209/933

[58] Field of Search ..... 271/288, 292, 293, 294, 271/295; 209/706, 655, 933, 934; 414/926

[56] References Cited

U.S. PATENT DOCUMENTS 4,746,111 5/1988 Naramore ..... 271/294 X

FOREIGN PATENT DOCUMENTS 3313753 10/1983 Fed. Rep. of Germany .

0023084 1/1986 Japan ..... 271/293

61-51462 3/1986 Japan .

61-94969 5/1986 Japan .

*Primary Examiner*—H. Grant Skaggs

*Assistant Examiner*—C. Druzbick

*Attorney, Agent, or Firm*—Fitzpatrick, Cella, Harper & Scinto

[57] ABSTRACT

A control method for a sheet sorter including a plurality of sorting bins, a sheet discharger for discharging sheets to the sort bins and a driver for moving the sort bins to present the sort bins to the discharger includes moving the sorting bins at a first speed in association with receipt of the sheet by one of the sorting bins and moving the sorting bins at a second speed in association with a discharge interval between the sheets discharged by the sheet discharger, by controlling the driver.

12 Claims, 18 Drawing Sheets

SHEET SORTER IMAGE FORMING APPARATUS HAVING SAME

FIELD OF THE INVENTION AND RELATED ART

The present invention relates to a sheet sorter, an image forming apparatus having the same and a control method for the sheet sorter. The image forming apparatus may be a copying machine, a printer, a laser beam printer or the like. In a conventional sheet sorter (sheet post-processing apparatus) attached to and used with an image forming apparatus, there are provided a plurality of sheet accommodating portions (bins), which are operated in interrelation with the image forming apparatus to receive the sheets in a sorted manner.

In the conventional sorters, when the sheet bins are selected for the respective sheets discharged, the sheet is discharged to the selected bin after the selection is completed by which the bin is stopped. Then, after the completion of the sheet discharge, the bins are started to move for the next selection.

Therefore, in the conventional sorters, each of the sheet discharging operations is effected necessarily with the start of the bin switching movement and the stoppage of the movement, with the result of production of noise and large peak current required for the switching operation.

In order to reduce the noise in the conventional apparatus, it is required to slow down the switching operation. However, it necessitates the reduction of the sheet discharge rate of the image forming apparatus, which is an additional problem. In order to reduce the peak current which is the second problem, it is required to add current control circuit or the like with the result of space required for the various parts which leads to increase of the cost of the entire apparatus.

SUMMARY OF THE INVENTION

Accordingly, it is a principal object of the present invention to provide a sheet sorter and a control method therefore, wherein the number of starting and stopping actions of the sheet accommodating portion switching operation is minimized without obstruction to the sheet discharge from the image forming apparatus used with the sheet sorter, without reducing the sheet discharge rate of the image forming apparatus, without the necessity of the space for additional parts and without the increase of the cost of the entire apparatus. Then, the noise and the level of the peak current stemming from the starting and stopping actions are reduced, and the total sheet post-processing is made more efficient.

According to an aspect of the present invention, when the sheet sorter is operated in the mode in which the sheet accommodator is switched for the respective sheet discharging operations, the accommodator switching operation is performed continuously with the sheet discharging operation, in which the speed of the sheet accommodator switching operation is changeable.

Since the switching operation is continuous, the noise and the level of the peak current is minimized during the sheet accommodator switching operation, and the sheet post processing efficiency is increased, without the reduction of the sheet processing speed and without increase of the manufacturing cost.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to Figures, the preferred embodiments of the present invention will be described in detail.

Figure 1:
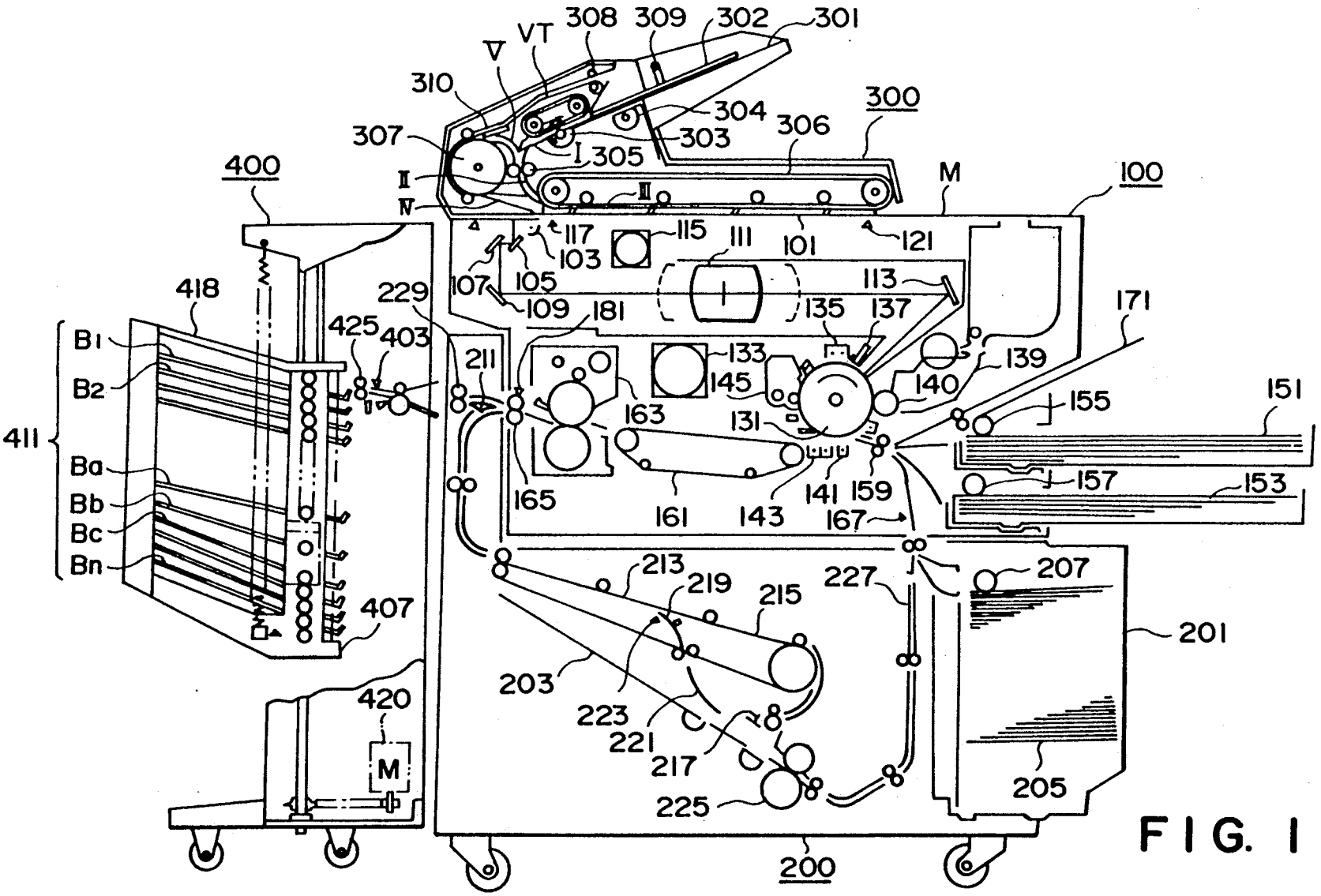
FIG. 1 is a sectional view of an image forming apparatus according to an embodiment of the present invention.

FIG. 1 shows the internal structures of a copying machine as an exemplary image forming apparatus to which the present invention is applicable. The copying apparatus includes a main assembly 100, a pedestal 200 having a duplex copy function for reversing a recording material (sheet of paper) in a duplex mode and overlay recording function for effecting plural recording operations on the same recording material, a circulating type original feeding device (RDF) for automatically feeding the originals, and a sorter for accommodating the recorded sheets in plural bins in the sorted manner. The devices 200, 300 and 400 are detachably mountable to the main assembly 100.

A. Main assembly (100)

The main assembly 100 has an original supporting platen glass 101 for supporting an original to be copied, an illumination lamp (exposure lamp) 103 for illuminating the original to be copied, scanning reflection mirrors (scanning mirrors) 105, 107 and 109 for deflecting the optical path of the light reflected by the original, a focusing lens 111 having a variable magnification function, and a fourth reflection mirror (scanning mirror) 113 for deflecting the optical path, an optical system motor 115 for driving the optical system including the scanning mirrors, and sensors 117 and 121.

The main assembly further comprises a photosensitive drum 131, a main motor 133 for driving the photosensitive drum 131, a high voltage unit 135, a blank exposure unit 137, a developing device 139, a developing roller 140, an image transfer charger 141, a separation charger 143 and a cleaning device 145.

The apparatus further includes a sheet feeding system including an upper cassette 151, a lower cassette 153, a manual feeding tray 171, sheet feeding rollers 155 and 157, a registration roller 159, a conveying belt 161 for conveying the record sheet having the recorded image to an image fixing device. The fixing device is designated by a reference numeral 163 and functions to fix the image on the recording material by heat and pressure. A sensor 167 is used in the operation in the duplex recording mode.

The surface of the photosensitive drum 131 is made of a seamless photosensitive member comprising a photoconductive layer and a conductive layer. The drum 131 is rotatably supported and is rotated in the direction indicated by an arrow by a main motor 133 actuated in response to depression of a copy start key which will be described hereinafter. Then, the preliminary process is performed to control the rotation of the drum 131 and to control the potential of the drum 131. Subsequently, the original supported on the original supporting plate glass 101 is illuminated by an illumination lamp 103 integrally supported with the first scanning mirror 105, and the light reflected by the original travels by way of the first scanning mirror 105, the second scanning mirror 107, the third scanning mirror 109, the lens 111 and the fourth scanning mirror 113, and is imaged on the drum 131.

The drum 131 is charged by a corona charger supplied from a high voltage unit 135. Subsequently, the light image (the image of the original) provided by the illumination lamp 103 is projected through a slit onto the drum 131, by which an electrostatic latent image is formed on the drum 131 through a known Carlson process.

Then, the electrostatic latent image on the photosensitive drum 131 is developed by a developing roller 140 of the developing device 139 into a visualized toner image, and the toner image is transferred by the image transfer charger 141 onto a transfer sheet which has been supplied in the manner described below.

The transfer sheet in the upper cassette 151, the lower cassette 153 or on the manual feed tray 171 is introduced into the main assembly by a sheet feeding roller 155 or 157, and is fed toward the photosensitive drum 131 in correctly timed relation with the leading edge of the latent image on the drum 131, by the registration roller 159. When the transfer sheet passes between the transfer charger 141 and the drum 131, the toner image is transferred from the drum 131 onto the transfer sheet. After the image transfer operation, the transfer sheet or paper is separated from the drum 131 by the separation charger 143, and is conveyed on the conveying belt 161 to an image fixing device 163 where the image is fixed on the transfer sheet by heat and pressure. Thereafter, the sheet is discharged to the outside of the main assembly 100 by the discharging rollers 165.

The drum 131, after the image transfer operation, continues to rotate, and the surface thereof is cleaned by the cleaning device 145 comprising the cleaning roller and the elastic blade.

B. Sorter (400)

The sorter 400 in this embodiment has 25 bin trays to receive the recorded sheet in sorted manner. The sorter is operable in a non-sorting mode, a sorting mode and a grouping mode. When the copy start key 605 in the display and operation panel 600 of the main assembly 100 is depressed, the sorter operates in one of the modes selected before the depression. A main assembly sheet discharge sensor 181 is effective to presence or absence of the sheet being discharged from the main assembly; and a sorter sheet discharge sensor 403 is effective to detect presence or absence of the sheet being passing between the sheet discharging rollers 405 of the sorter. Designated by B1–Bn are sorting bins.

(i) Non-Sorting Mode

In the non-sorting mode, the bins are first moved to a position where a non-sorting mode home position sensor 407 is actuated (non-sorting mode home position), and thereafter, the sheet receiving operation is started. After the start, the bin shifting motor 420 is not operated, and therefore, the bin shifting operation is not performed. Therefore, the copied sheets are sequentially discharged by the discharging rollers 229, and are received by the tray through the sorter discharging rollers 405.

(ii) Sorting Mode

Three originals are placed on the tray 301, and the number of required copies is set to 4, for example, and then the copy key is pressed. Then, the first original is fed to and set on the platen 101, and four copies thereof is produced. The four copies are sequentially received by the sorting bins B1–B4, respectively. Then, the first original is returned to the tray 301, and the second original is fed to and set on the platen, and then four copies are produced. The copies are sorted into the bins B1–B4. The same operation is repeated.

The sorting operation in the sorting mode will further be described. When an initial signal for the bin is produced by the main assembly, and when the topmost bin is above the sheet discharging rollers 405 of the sorter, the bin shifting motor 420 is actuated to shift the bins so that the topmost bin is lowered below the sorter discharging rollers 405, and then the bins are stopped. This is called "sorting mode home position".

The copy sheets having the images are sequentially discharged by the discharging rollers 229 of the pedestal, and are discharged to the respective bins by the discharging rollers 405 of the sorter. At this time, the bin shifting operation is performed to raise or lower the bins to discharge the sheets to the selected bins.

Figure 2:
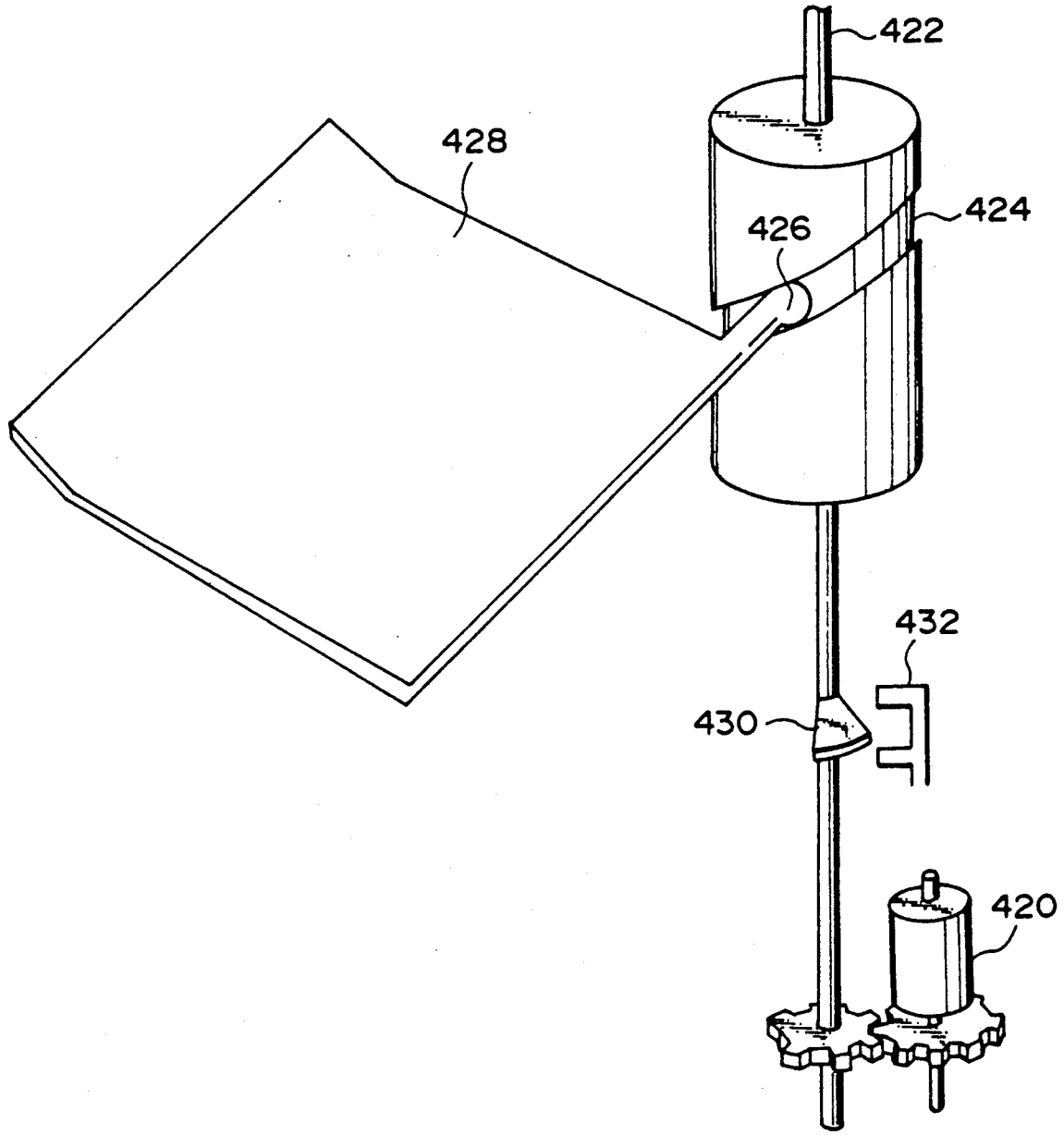
FIG. 2 is a perspective view of a bin shift driving mechanism of a sorter according to an embodiment of the present invention.

FIG. 2 shows the bin shifting driver comprising a bin shifting motor 420, a bin shifting roller shaft 422 which rotates through gears by rotation of the bin shifting motor. Designated by references 428 and 426 are the bin and an end of the bin. The end 420 is engaged in a groove 424 formed in the bin shifting roller so as to be movable in the groove 424. More particularly, by rotation of the roller shaft 422 and the groove 424, the end 426 of the bin supported in the groove 424, and therefore, the bin 428 is moved up and down.

Elements 430 and 432 constitute a detector in the home of a combination of a sector member and a transparent type sensor, and the combination will hereinafter be called "lead cam sensor". By properly selecting the size, configuration and position of the sector member 430, the position of the bin can be detected depending on whether the sector member 430 intersects the optical path of the sensor 432. In this embodiment, the transparent sensor produces a high level signal when the bin is at a position at which it can receive the sheet, and the sensor output is in the off-state when the bin is at a position for not receiving the discharged sheet. The size, configuration and position of the sector member 430 are determined to accomplish this.

(iii) Grouping Mode

Three originals are placed on the tray 301, and the number of required copies i set to 4, for example, and the copy key is pressed. The first original is fed to and set on the platen 101, and four copies are produced. The four copy sheets are all received by the sorting bin B1. The first original is returned to the tray 301, and the second original is set on the platen, and four copies are produced. The four copies are all received on the sorting bin B2. The same operation is repeated.

The operation in the grouping mode will further be described. First, similarly to the sorting mode operation, the bin shifting motor 420 is operated to shift the bins to the sorting mode home position. The copy sheets having the copied images are sequentially discharged by the discharging rollers 165 of the main assembly, and are received by the bin 411 by the discharging rollers 405 of the sorter. Each time the new originals are set on the platen, the bin is raised or lowered by the bin shifting motor 420.

C. Sorter Controlling Device (500)

Figure 4:
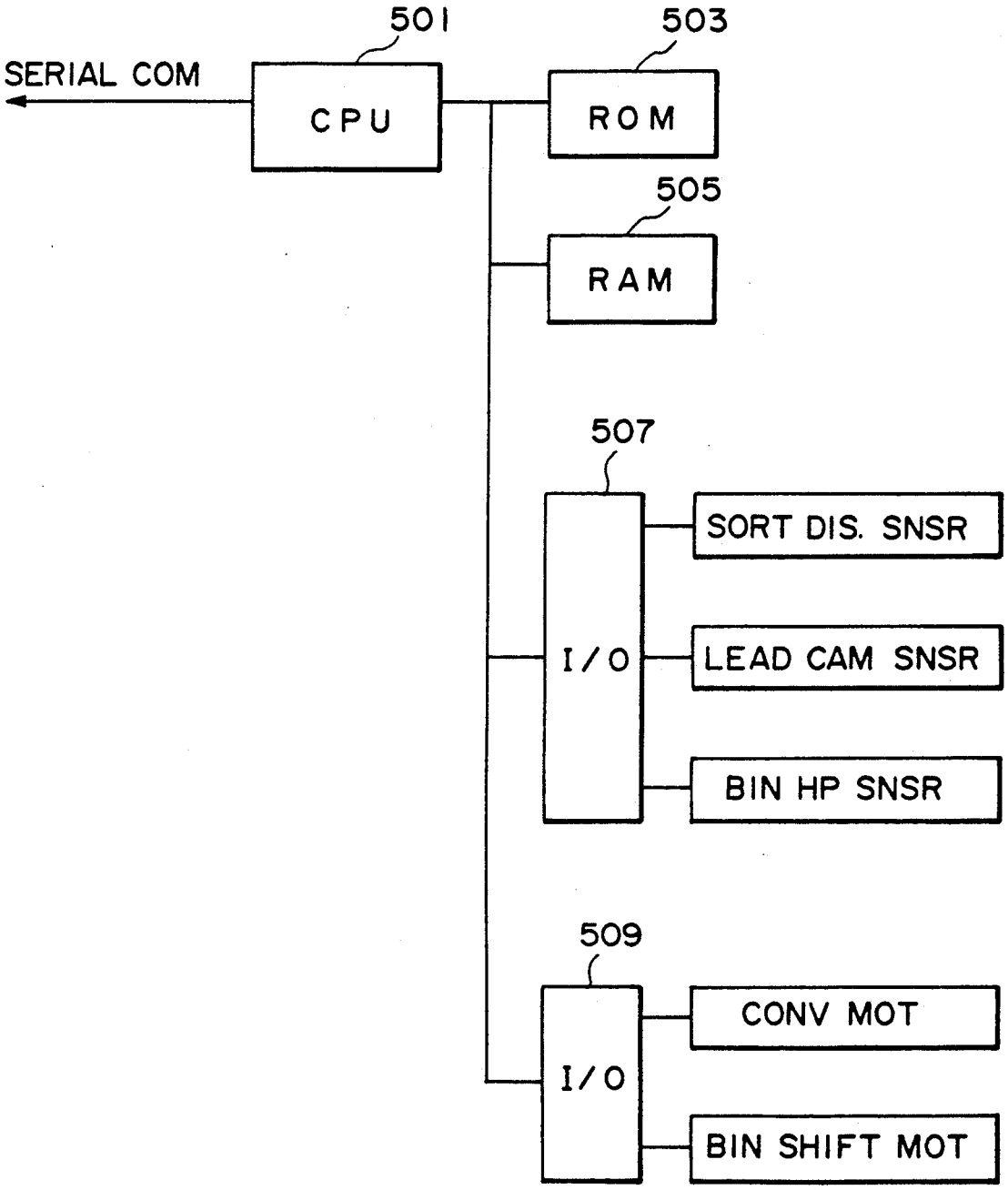
FIG. 4 is a block diagram illustrating the structure of the circuit of the control system for the sorter according to an embodiment of the present invention.

FIG. 4 shows an example of a circuit of a sorter controller 500 of the apparatus of FIG. 1. As shown in FIG. 4, the controller 500 includes a control device comprising a central processing unit (CPU) 501, read only memory (ROM) 503, random access memory (RAM) 505, an input port 507 and an output port 509 and others. A control program is stored in the ROM 503, and input data or working data are stored in the RAM 505. The input port 507 is connected with switches and various sensors such as the lead cam sensor (430, 432), and the output port 509 is connected with loads such as the bin shifting motor 420. The CPU 501 controls various parts through a bus in accordance with the control program stored in the ROM 503. The CPU 501 is provided with a serial interface to effect serial communication with a CPU of the main assembly of the copying machine, for example, to control various parts in accordance with the signals from the main assembly.

Referring to FIGS. 5, 6, 7, 8, 9 and 10 (flow charts), the operation of the apparatus according to this embodiment will be described.

Figure 5:
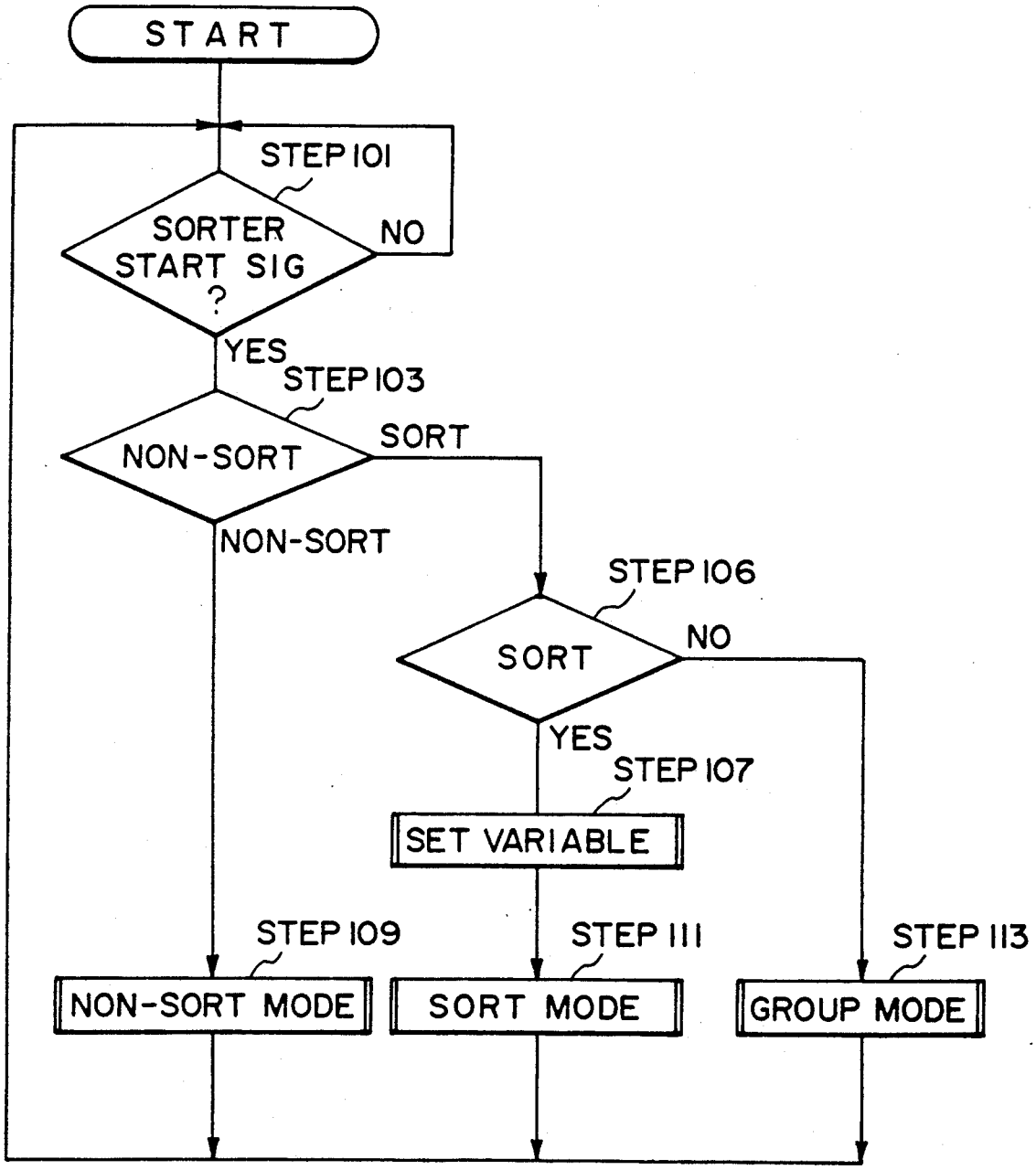
FIGS. 5, 6, 7, 8 and 12 are flow charts illustrating operational steps of the apparatus according to an embodiment of the present invention.

As shown in FIG. 5, the copy start key 605 of the main assembly of the copying apparatus, for example, is first pressed, upon which the copying operation starts, and a serial sorter starting signal is supplied from the main assembly of the copying apparatus. The sorter 400 waits for the signal (step 101), and when it receives the sorter starting signal, a step 103 is executed by which the mode of the operation during one job until the sorter starting signal disappears, and the data of the determined mode is stored in the RAM 505. Then, various parts are operated by the determined operation mode. At step 103, the discrimination is made as to whether the mode is the non-sorting mode or not. If it is the non-sorting mode, a step 109 is executed. If it is not the non-sorting mode (step 103), a step 105 is executed, where the discrimination is made as to whether or not it is the sorting mode. If so, an operational variables setting process (step 107) which is the initial process of the sorting mode is executed (step 107). Thereafter, the step 111 is performed. If the result of the discrimination at step S105 is negative (not the sorting mode), it is discriminated as being the grouping mode, so that the operational sequence proceeds to the grouping mode (step 113). After completion of the operation in one of the above modes, one job completion is discriminated, and the program returns to the initial step 101.

Figure 6:
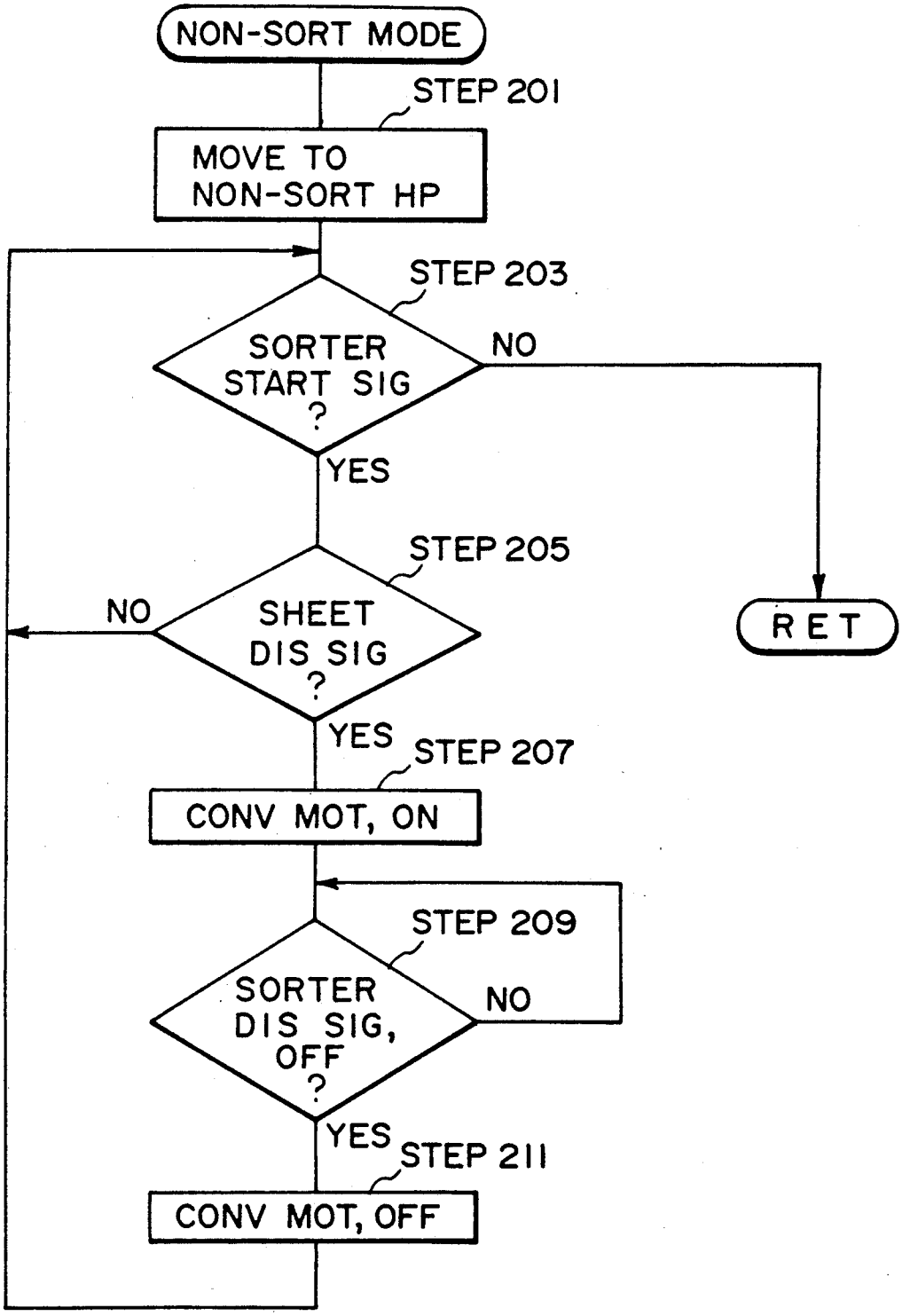

Referring to FIG. 6, the operation in the non-sorting mode will be described. In the non-sorting mode, the copy sheets are discharged onto the topmost tray. To achieve this, the bin unit is shifted to such a position that the non-sorting mode home position sensor 407 is actuated (step 201). Then, the discrimination is made as to whether the sorter starting signal is produced from the main assembly or not (step 203). If not, the operational sequence returns to the main routine. If so, a step 205 is executed by which a sheet discharge signal of the main assembly is awaited. Upon production of the sheet discharge signal of the main assembly, the conveying motor for discharging the sheet is rotated at step 207. The conveying motor is continued to rotate until the sheet discharge sensor of the sorter detects the discharge of the sheet, and upon the detection (step 209), the conveying motor is stopped (step 211), and a step 203 is executed where the sorter waits for the sorter starting signal to disappear.

Figure 7:
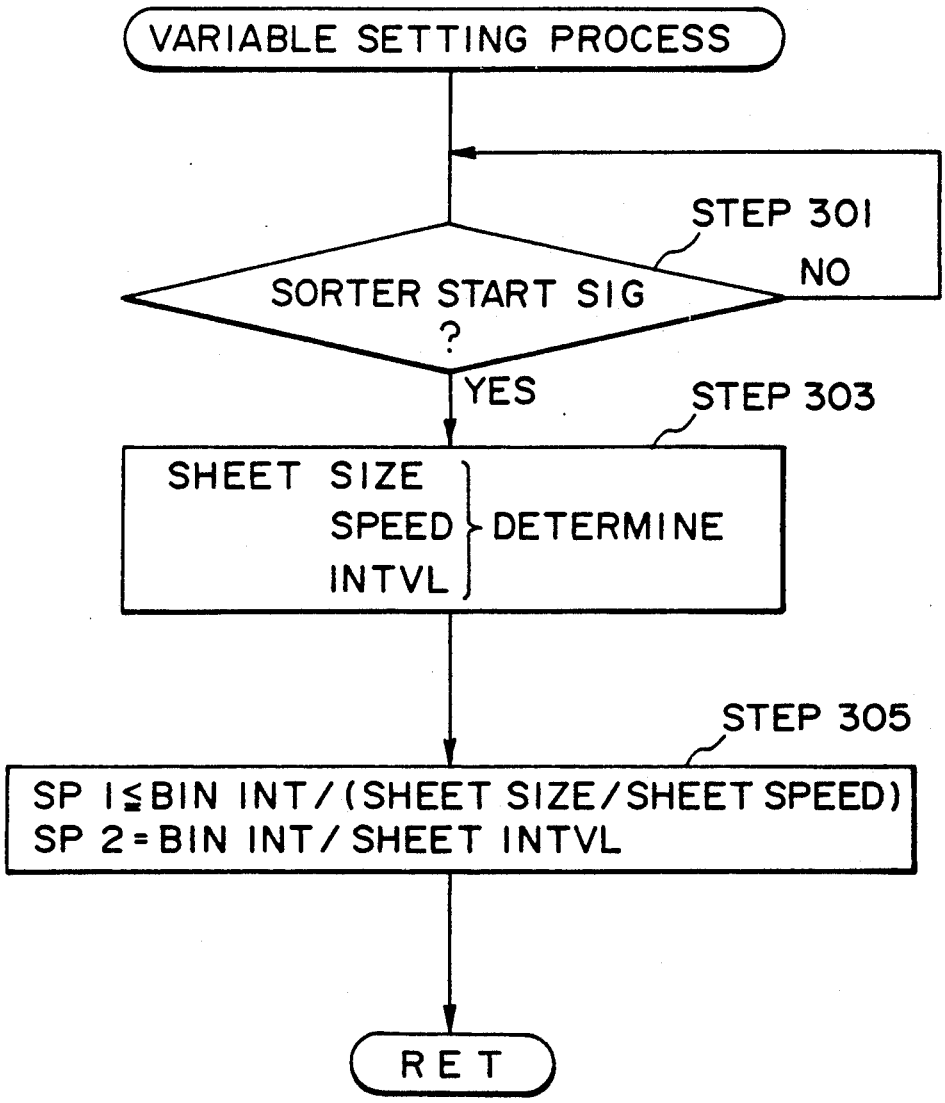

Referring to FIG. 7, the preliminary process (operational variables setting process) of the sorting operation which is one of the features of the present invention will be described.

At step 301, the discrimination is made as to the presence or absence of the sorter starting signal. If it is present, step 303 is executed by which the determination is made as to the size of the sheets going to be discharged from the main assembly, the discharge speed (mm/sec) thereof, and a time interval (interval between the discharged sheets from the main assembly) between adjacent discharged sheets when the sheets are continuously discharged. Then, a step 305 is executed, to calculate on the basis of the above determinations two bin shifting speeds (SP1 (first speed) and SP2 (second speed)). The first and second speeds SP1 and SP2 will be described in detail hereinafter.

Figure 8:
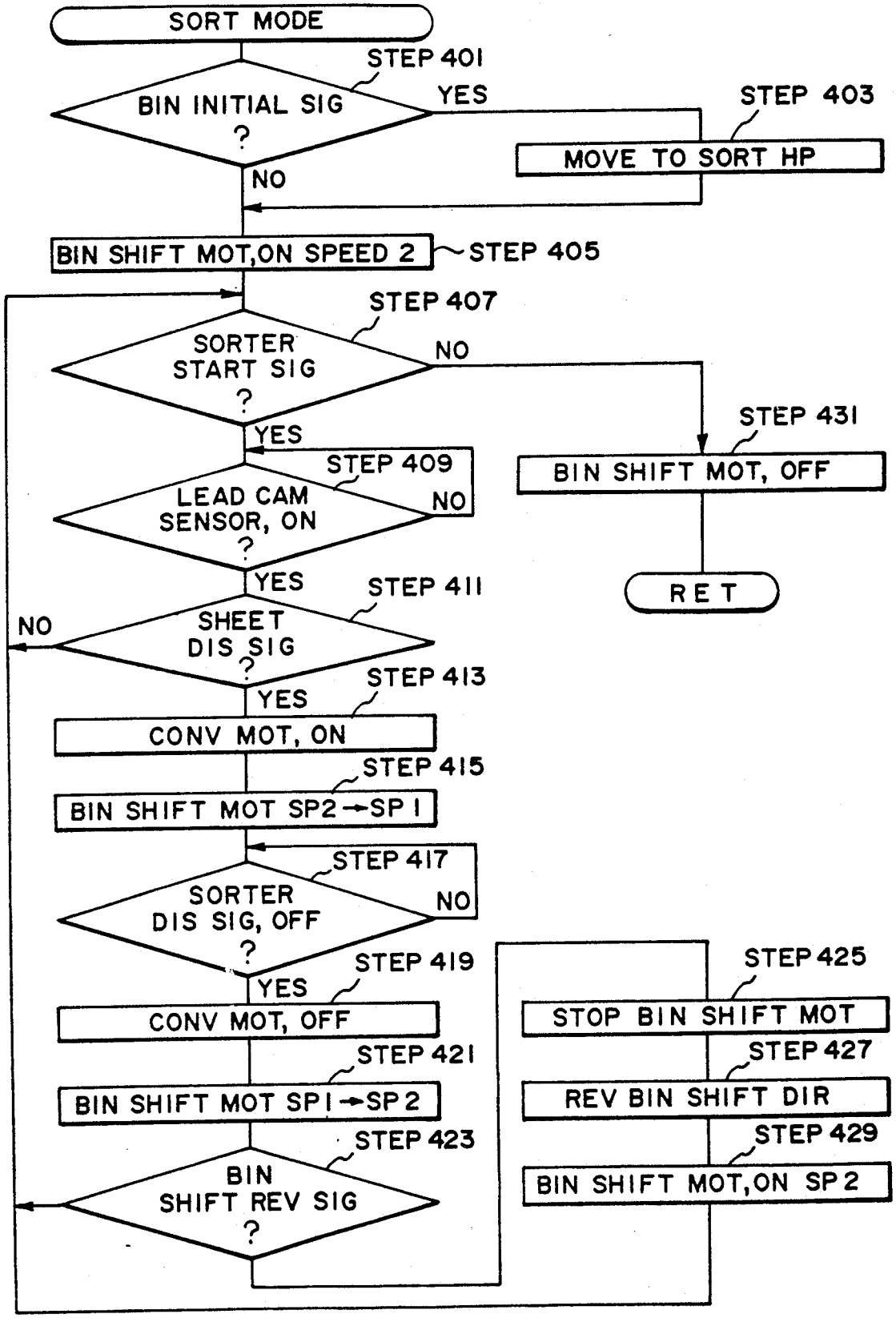

Referring to FIG. 8, the operation in the sorting mode will be described along the flow chart of this Figure. First, the discrimination is made as to whether or not the bin initial signal is produced from the main assembly (step 401), the bin initial signal being indicative of the necessity of returning the bin unit to the sorting mode home position. If so, the bin unit is moved to the sorting mode home position (step S403).

Then, the bin shifting motor is rotated at the second speed SP2 (step 405) calculated by the operational variable setting process described above. At step 407, the presence or absence of the sorter starting signal is discriminated. If it is present, the rotation of the bin shifting motor is stopped (step 431), and the operational sequence returns to the main routine.

If the sorter starting signal is discriminated at step 407 as being produced, a step 409 is performed by which the discrimination is made as to whether or not the lead cam sensor is actuated (step 409). When the lead cam sensor is actuated, that is, when the bin of the sorter reaches to the position at which it can receive the sheet, a step 411 is carried out in which a sheet discharge signal indicative of the sheet being discharged from the main assembly is awaited (step S411). When the main assembly sheet discharge signal is actuated at step 411, the conveying motor is rotated to discharge the sheet (step 413), and the rotational speed of the bin shifting motor is switched from the second speed SP2 to the first speed SP1 (step 415). When the sorter discharging signa is deactuated, that is, when the discharging operation is completed (step 417), the conveying motor is stopped (step 419), and the rotational speed of the bin shifting motor is switched back to the second speed SP2 (step 421). Thereafter, the discrimination is made as to whether or not the request for reversing the bin shifting direction is produced (step 423). If not, the operation returns to the step 407. If so, that is, if the requirement for the reversing is produced, the bin shifting motor is stopped (step 425) and reversed (step 427). The rotational speed of the bin shifting motor is set to the second speed SP2, and then, it returns to the step 407.

Figure 9:
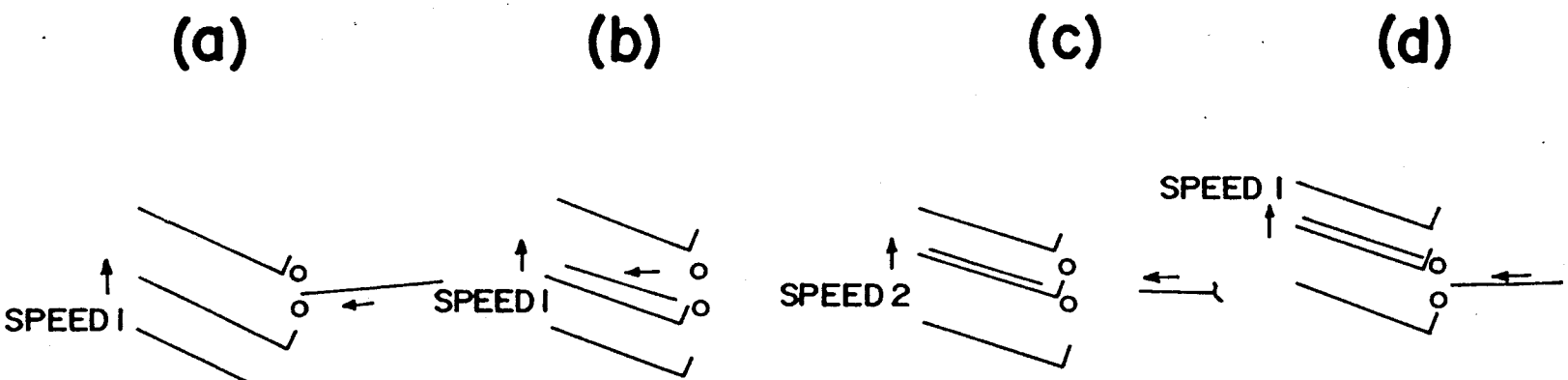
FIGS. 9A, 9B, 9C and 9D are schematic side views illustrating operation in a sorting mode.

The first and second speeds SP1 and SP2 of the bin shifting operation are calculated on the basis of a length of the sheet to be discharged, measured along the direction of the sheet conveyance, a conveying speed, a sheet discharge interval and an interval between adjacent bins of the sorter. As shown in FIG. 9(*a*), the bin shifting speed is set to the first speed SP1 at the point of time when the discharge of the sheet starts; the bin shifting operation continues in parallel with the sheet discharging operation; and the sheet discharge is completed while the bin is in the sheet receivable state, as shown in FIG. 9(*b*). The first speed SP1 is such a bin shifting speed that the sheet discharge is started and is completed within a time period from the time when the bin becomes sheet receivable state (detected by the lead cam sensor) to the time when the bin becomes non-receivable state. If the bin is moving upwardly at this time as shown in FIG. 9(*b*), the trailing edge of the sheet is received by the bin at a relatively lower position, and therefore, the sheet can be received under a good condition. When the sheet non-receivable state is reached (FIG. 9(*c*)), the bin shifting speed is switched to the second speed SP2, and the second speed SP2 is maintained during the continuing bin shifting operation until the next bin reaches the sheet receivable state. Here, the second speed SP2 is that that the switching from the non-receivable state to the receivable state is completed within the period of the discharge interval. When the sheet size is long, and the discharge interval is small, the second speed SP2 is larger than the first speed SP1. On the other hand, when the sheet size is short, and the sheet discharge interval is long, the second speed SP2 is lower than the first speed SP1. Because of the variable bin shifting speed, the bin shifting operation can be continued without interruption or stoppage irrespective of the size of the discharged sheet measured along the conveyance direction, even if the length of the sheet discharging period and the length of the non-sheet-discharging period are different.

Figure 10:
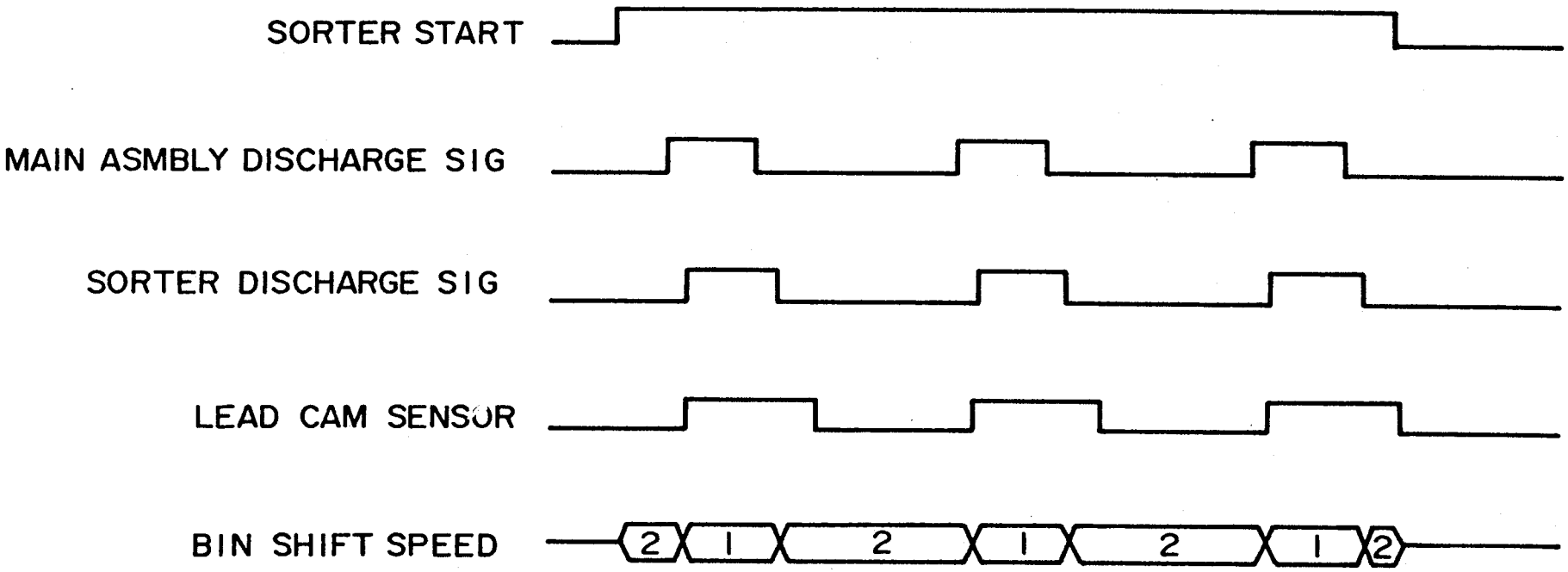
FIGS. 10, 11A and 11C are timing charts of the operation in the sorting mode.

FIG. 10 is a timing chart in the above operations in the sorting mode. As will be understood from this Figure, the bin shifting motion continues during the sorting operation, that is, the during the sort starting signal is at the high level, except for the reversal of the bin shifting direction. This is one of the features of the invention.

Figure 11A:
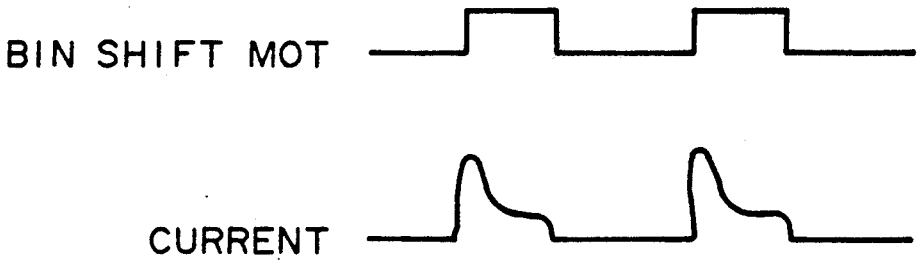
Figure 11B:
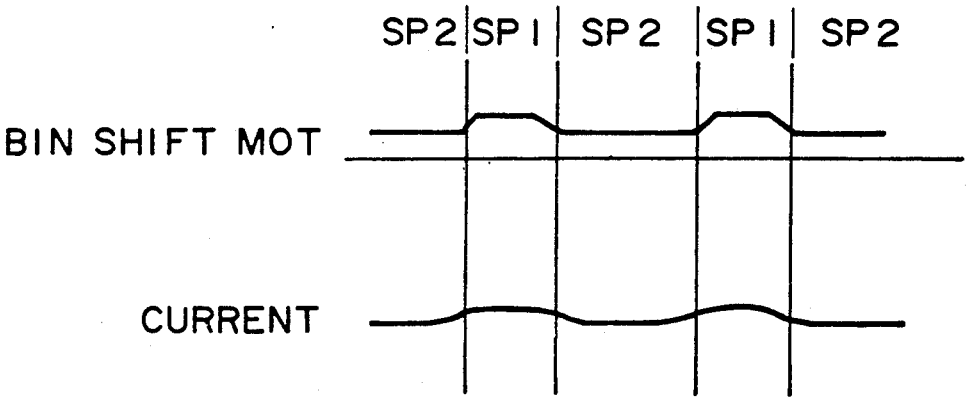

FIG. 11 shows a waveform of the current. As will be understood from this Figure, the peak current required may be small in this aspect of the present invention.

Figure 12:
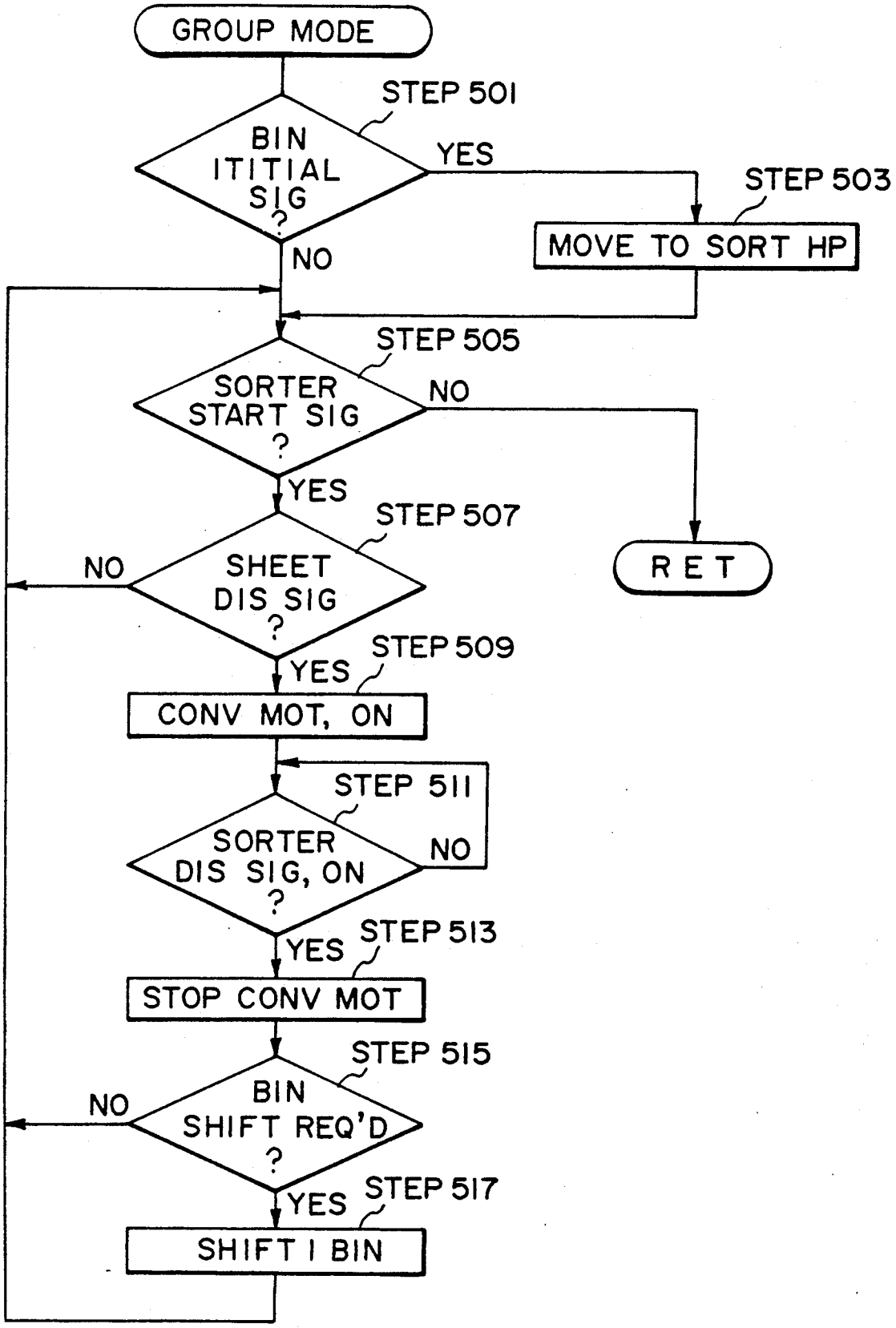

Referring to FIG. 12, a grouping mode will be described.

First, the discrimination is made as to whether the bin initial signal is produced in the main assembly of the copying machine at step 501. Only if so, the bin unit is moved to the home position at step 503. Next, a step 505 is executed where the discrimination is made as to whether the sorter start signal is produced in the main assembly of the copying machine or not. If so, it is deemed that the job continues, and a step 507 is executed. If not, it is deemed that one job is completed, and the program returns to the main routine. At step 507, the presence or absence of the sheet discharging signal is discriminated. If it is present, the program progresses to a step 509. If not, it returns to the step 505. Step 511 is a sheet conveying step to discharge the sheet into the bin 411, and after the operation, step 515 is executed, in which the discrimination is made as to whether or not the bin shifting signal is produced in the main assembly of the copying apparatus. Only if so, the bin unit 411 is shifted by one bin (step 517), and then the program returns to the step 505.

EMBODIMENT 2

Figures 13, 13A:
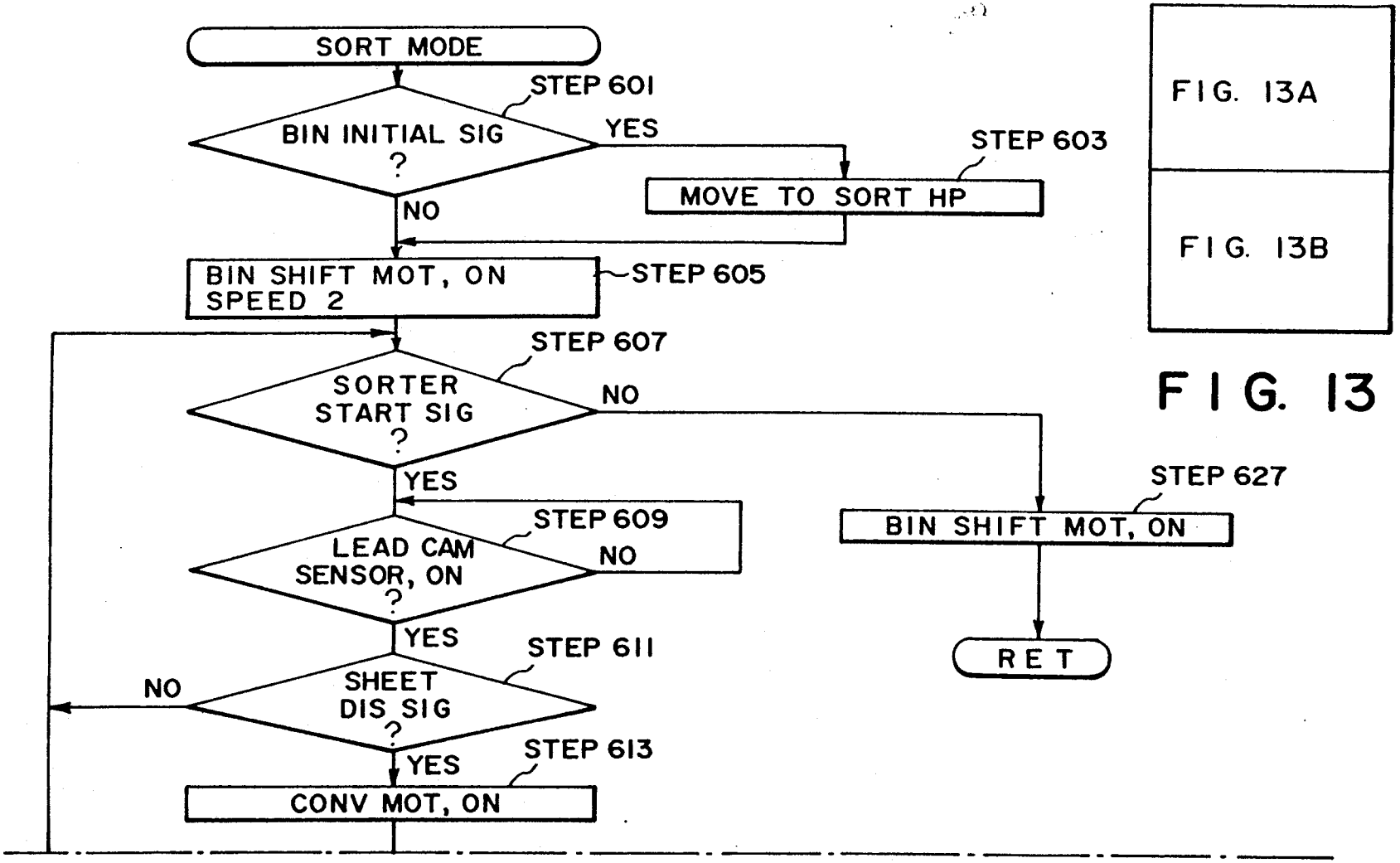
FIG. 13 is a flow chart illustrating the operation in the sorting mode.
Figure 13B:
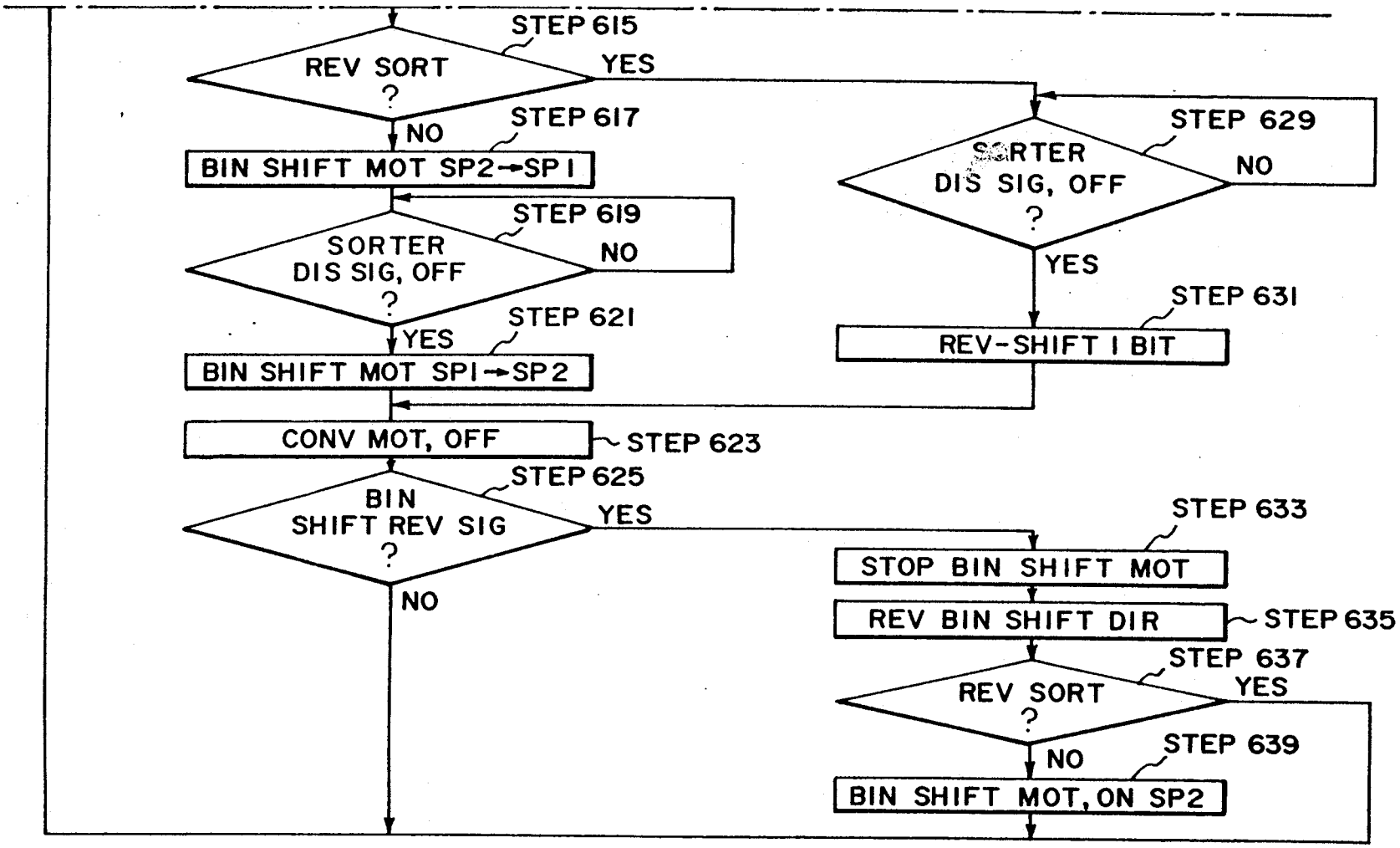

In the foregoing embodiment, as shown in FIG. 9 if the bin moves upwardly during the sorting mode operation, the sheet is discharged to the bin located at a relatively low position, and therefore, the sheet is received by the bin in the better condition. However, when the bin moves downwardly, the movement is opposite, and therefore, the bin shifting operation may be temporarily stopped as long as the bin moves downwardly during the sorting mode operation. In this case, the power required for the bin shifting motor may be small since the bin is moving downwardly, so that the advantages of the lower peak current level is not lost. Since the operation in this case is also a sorting mode operation, the operational variable setting process is executed similarly to the foregoing embodiment, and thereafter, the steps in the flow chart of FIG. 13 are executed. Up to the operational variable setting process, the operations are the same as in the foregoing embodiment. Referring to FIG. 13, the operation of the apparatus of the second embodiment will be described.

First, the discrimination is made at step 601 as to whether or not the bin initial signal indicative of the necessity of returning the bin unit to the sorting home position is produced in the main assembly of the copying machine. If so, the bin unit is moved to the sorting home position at step S603. Then, the bin shifting motor is rotated at the second speed SP2 calculated through the operational variable setting process, at step 605. At step 607, it is discriminated that whether or not the sorter starting signal is produced or not. If not, the bin shifting motor is stopped at step 627, and the program returns to the main routine. If the sorter start signal is discriminated at step 607 as being produced, the processor progresses to a step 609 where the discrimination is made as to whether or not the lead cam sensor is actuated at step 609.

When the lead cam sensor is actuated, that is, when the bin position of the sorter becomes such that it can receive the discharged sheet, the program progresses to a step 611 where actuation of a main assembly sheet discharge signal is awaited at step 611. When the main assembly sheet discharge signal is discriminated at step S611 as being actuated, the conveying motor is rotated to discharge the sheet at step 613, and the discrimination is made as to whether or not it is during the reversal sorting movement. If not, the rotational speed of the bin shifting motor is switched from the second speed SP2 to the first speed SP1 at step 617. When the sheet discharge signal is deactuated, and the sheet discharging action is completed (step 619), the rotational speed of the bin shifting motor is returned to the second speed SP2 (step 621). If the reversal sorting movement is discriminated at the step 615, the processor progresses to a step 629 where deactuation of the sorter discharging signal is awaited. When it is deactuated, the bin unit is reversely shifted by one bin at step 631. Subsequently, the conveying motor is deenergized at step 623, and then, the discrimination is made as to whether or not the reversal of the bin shifting direction is required, at step 625. If not, the program returns to the step 607. If so (the reversal is required), a step 633 is executed by which the bin shifting motor is temporarily stopped, and the bin shifting direction is reversed (step 635). If not during the reversal sorting movement, the bin shifting motor is actuated with the second speed SP2 (steps 637 and 639). Then, the program returns to the step 607.

EMBODIMENT 3

Where the difference between the first bin shifting speed SP1 and the second speed SP2 calculated is smaller than a tolerance, for example, where the sizes of the sheets discharged from the image forming apparatus are the same, and the intervals between adjacent discharged sheets are the same as the size of the discharged sheets, or the like, the bin shifting speed is not required to be changed. Thus, the tolerance is determined in consideration that the operation is not obstructed.

In such a case, the bin shifting operations can be performed continuously at a constant speed smoothly, and therefore, the mechanical change in the apparatus can be minimized, by which the service life of the entire apparatus can be increased.

Referring to FIGS. 14–17, the operation of the third embodiment will be described.

In FIGS. 14, 15, 16 and 17, the operational variables setting process is executed to calculate the first speed SP1 and the second speed SP2 similarly to the foregoing embodiment (steps 701, 703, 705, 721, 723, 725, 741, 743 and 745).

Figure 14:
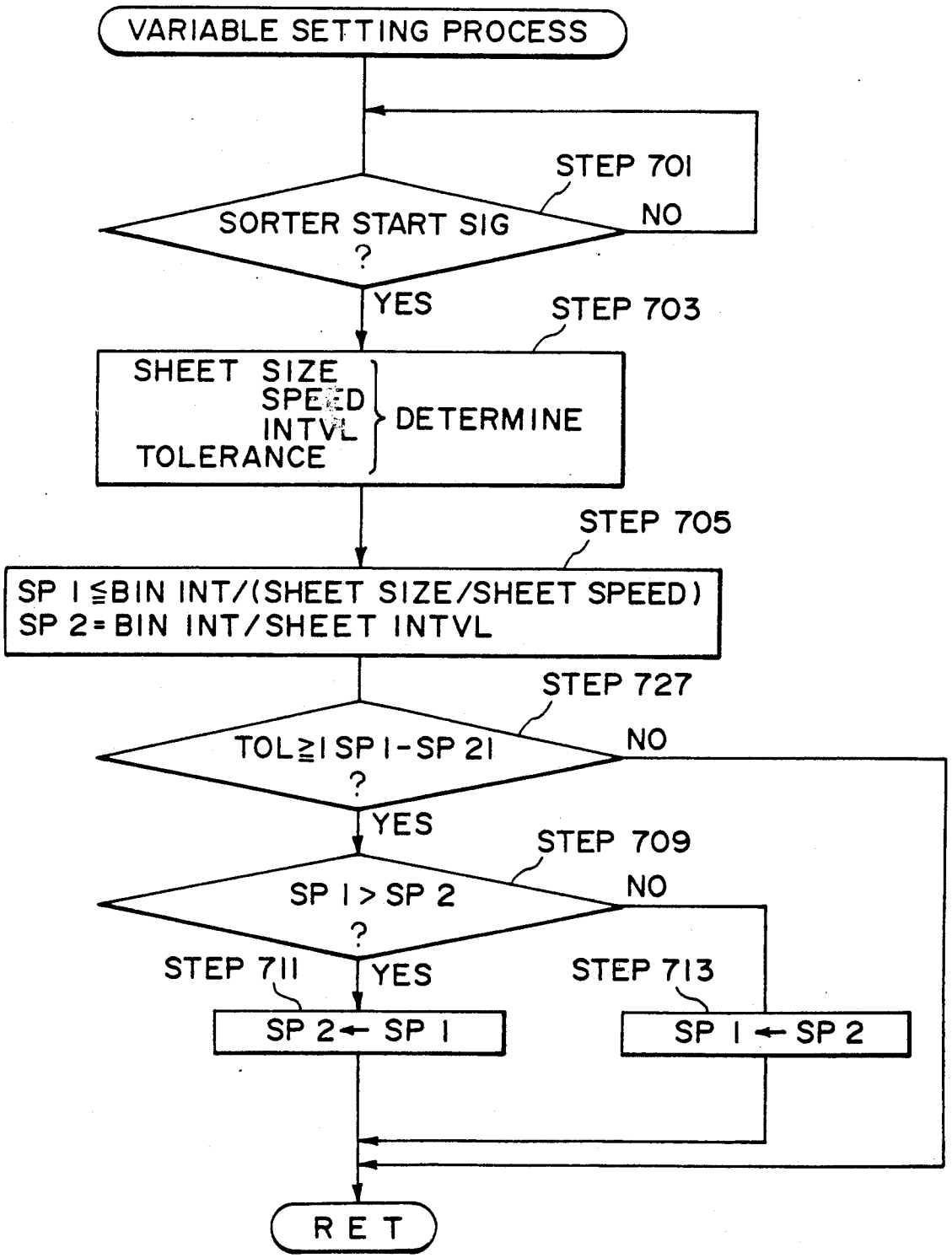
FIGS. 14, 15, 16 and 17 are flow charts of the operation in the apparatus according to a third embodiment of the present invention.
Figure 15:
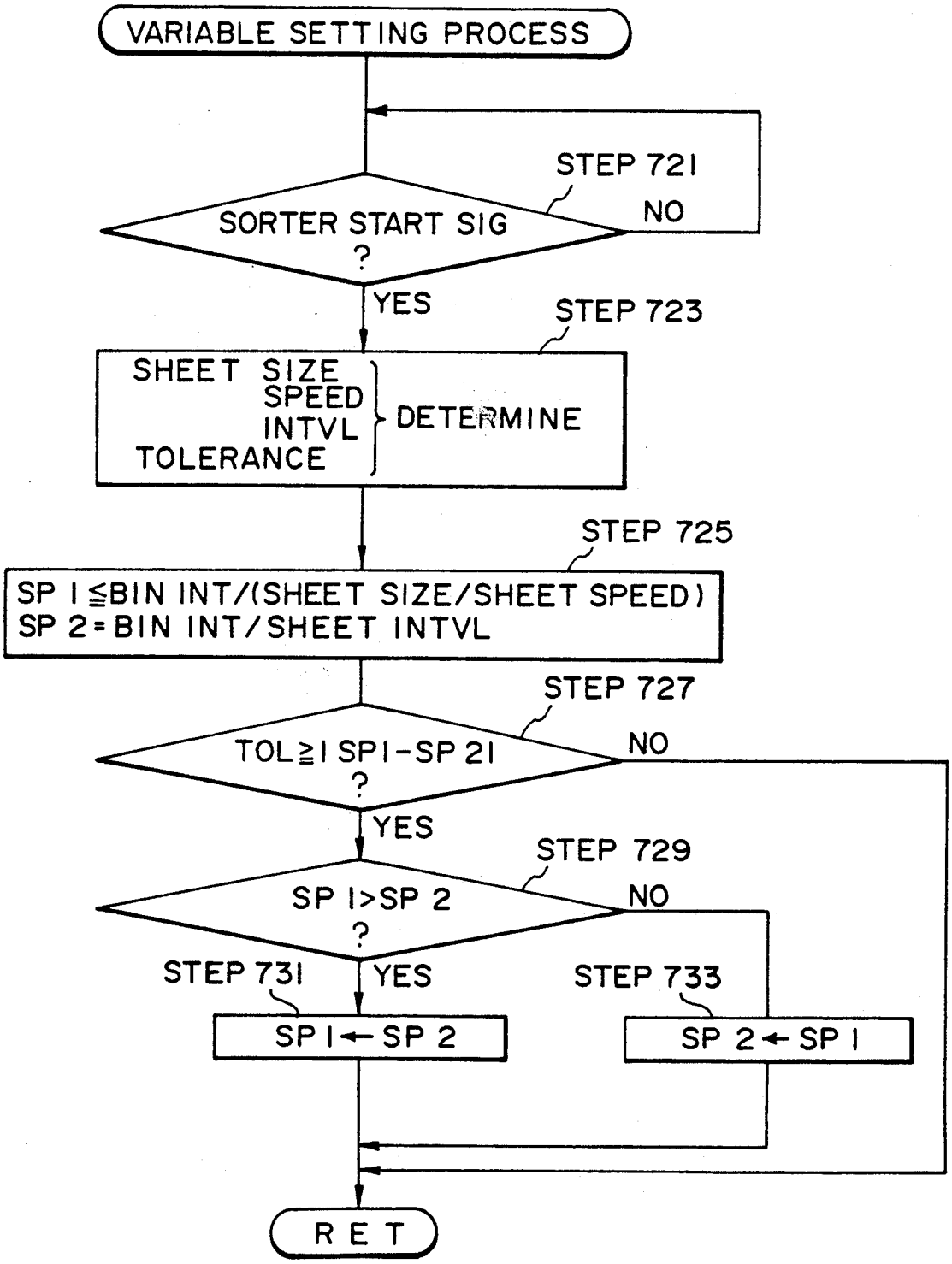
Figure 16:
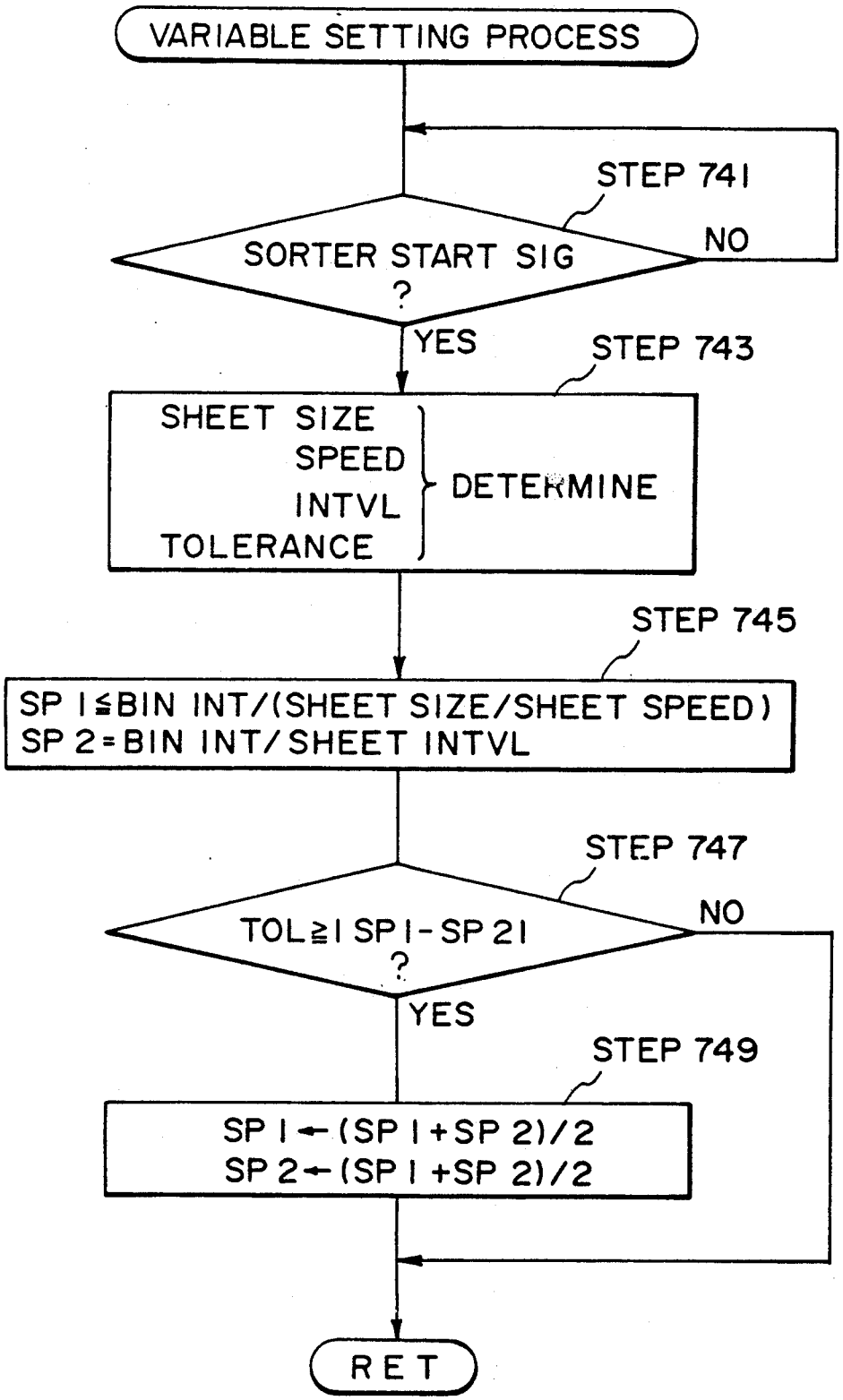
Figure 17:
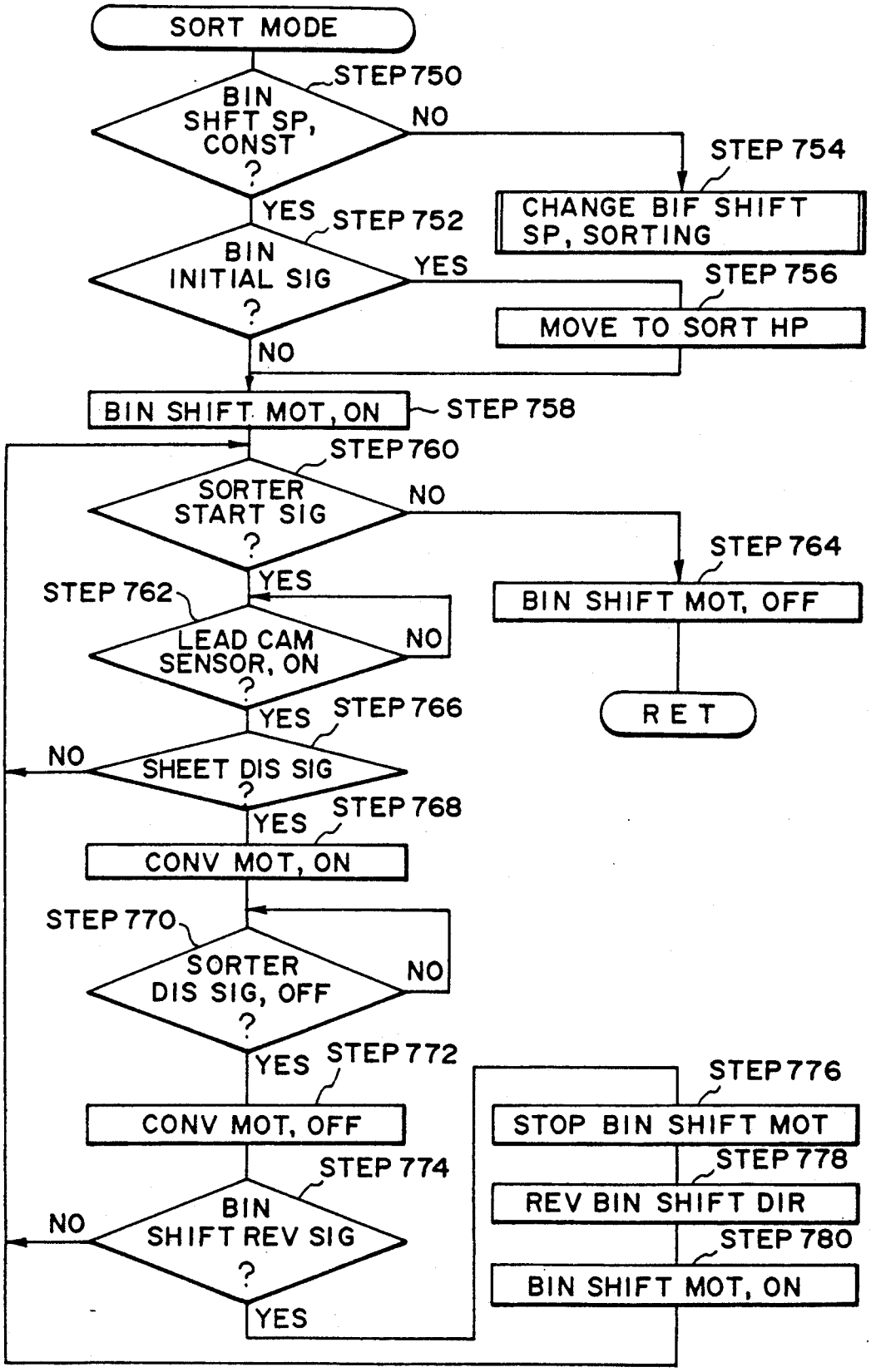

In the case of FIGS. 14, 15 and 16, the comparison is made between the predetermined tolerance (constant) and the first speed SP1 and the second speed SP2 (steps 707, 727 and 747). If the difference is larger than the tolerance, the sorting process is executed in the similar manner in the foregoing embodiment with two shifting speeds. If, the difference is smaller than the tolerance, bin shifting speed is set to the higher speed in the case of FIG. 14, to the lower speed in the case of FIG. 15, to the average of the two speeds in the case of FIG. 16, and then, the program progresses to the next step. By setting the bin shifting speed to one of the constant speed, the bin unit is moved by the constant speed.

Subsequently, the program processes to a step 750. When the bin shifting speed is not constant, the sorting process is executed with the bin speed shifted similarly to the foregoing embodiment (step 754). If it is discriminated at step 750 that the bin shifting speed is constant, the program progresses to a step 752 where the discrimination is made as to whether or not the bin initial signal indicative of necessity of the returning the bin unit to the sorting home position in the main assembly or not. If so, the bin unit is moved to the sorting home position (step 756).

Then, the bin shifting motor is rotated at the calculated bin shifting speed (step 758). At step 760, the discrimination is made as to whether or not the sorter starting signal is produced. If not, the rotation for the bin shift is stopped at step 764, and the program returns to the main routine. If the sorter starting signal is produced at step 760, the processor progresses to a step 762 where the discrimination is made as to whether or not the lead cam sensor is actuated (step 762). When the lead cam sensor is actuated, that is, when the bin reaches the sheet receivable position, the program progresses to a step 766 where the main assembly sheet discharging signal is awaited. When the main assembly sheet discharge signal is discriminated as being actuated at step 766, the conveying motor is rotated to discharge the sheet at step 768, and the deactuation of the sorter sheet discharge signal is awaited (step 770).

When the sorter sheet discharge signal is deactuated, and the sheet discharge is completed (step 770), the conveying motor is stopped (step 722), and the discrimination is made at step 774 as to whether the bin shift direction reversing signal is produced or not. If not, the program progresses to a step 760. If so, the bin shifting operation is stopped (step 776) to reverse the bin shifting direction (step 778), and the bin shifting motor is rotated again at a constant speed at step 780.

As described in the foregoing, if the constant speed bin shifting operation is possible, the smooth bin shifting operation and the reduction of the mechanical load are realized.

The description will be made as to the other structure.

D. Pedestal (200)

The pedestal 200 is detachably attached to the main assembly 100. It comprises a deck 201 capable of accommodating 2000 transfer sheets and an intermediate tray 203 for a duplex copying function. A lifter 205 of the deck 201 operated to is elevate in accordance with the amount of the transfer sheets contained therein so as to assure the contact of the transfer sheet to the pick-up roller 207 at all times.

The pedestal further comprises a sheet discharge flapper 211 for switching the sheet discharge passage between a duplex recording and overlaying recording passage and a sheet discharge passage, sheet conveying passages (conveying belt) 213 and 215, a weight 213 for confining the transfer sheet in the intermediate tray 203, wherein the transfer sheet having passed through the sheet discharge flapper 211 and the conveyance passages 213 and 215 is inverted in its facing orientation and then is accommodated in the intermediate tray 203 for the duplex copy. A flapper 219 functions to switch between the duplex copy and the overlaying copy passages and is disposed between the conveying passage 213 and the passage 215. When it is rotated upwardly, it introduce the transfer sheet to the overlaying recording passage 221. An overlaying record discharge sensor 223 functions to detect a trailing edge of the transfer sheet passing through the overlaying record flapper 219. A feeding roller 225 functions the transfer sheet toward the drum 131 through the passage 227. Discharging rollers 229 function to discharge the transfer sheet to the outside of the apparatus.

During the duplex recording (duplex copying) or overlaying record (overlaying copying) operation, the sheet discharge flapper 211 of the main assembly 100 is raised up so that the transfer sheet having the recorded image is accommodated in the intermediate tray 203 through the conveying passages 213 and 215 through the pedestal 200. During the duplex recording, the overlaying record flapper 219 is at the lower position, whereas during the overlaying recording operation, the flapper 219 is at the upper position. The intermediate tray 203 is capable of accommodating 99 copy sheets, for example. The transfer sheets accommodated in the intermediate tray 203 are confined by the intermediate tray weight 217.

During the backside recording and the overlaying recording, the transfer sheet in the intermediate tray 203 is fed to the registration roller 159 of the main assembly 100 from the bottom of the transfer sheets by the cooperation between the pick-up roller 225 and the weight 217 through the passage 227.

E. RDF (Recirculation Type Document Feeder) (300)

The document feeder 300 has a stacking tray 301 on which a set of originals 302 is placed. When the originals are one-sided or simplex originals, the bottom original is singled out by a crescent roller 304 and a separating roller 303, and the originals is conveyed through passages I and II to an exposure position on the platen glass 101 by a wide belt 306, and is stopped there. Then, the copying operation is started. After the copying operation is completed, the original is advanced through a passage III to a passage V by a large conveying roller 307, and is returned to the top surface of the set of originals 302 by a sheet discharging roller 308. A recycle lever 309 is effective to detect one circulation of the originals. It is placed on the top of the set of originals at the start of the original supply operation, and is permitted to fall when the originals are sequentially supplied to such an extent that the trailing edge of the final original passes by the recycle lever 309. By the falling, one circulation of the original is detected.

When the originals are both-sided, that is, duplex originals, the original is once supplied through passages I, II and III, temporarily. Then, the leading edge of the original is introduced into a passage IV by switching a rotatable flapper 310, and is conveyed onto the platen glass 101 by the wide belt 306 through the passage II, and is stopped there. By the rotation of the large conveying roller 307, the original is inverted through the passages III-IV-II.

By conveying the originals one by one through the passages I-II-III-IV-VI until the one circulation is detected by the recycle lever 309, the number of the originals in the set 302 can be counted.

Figure 3:
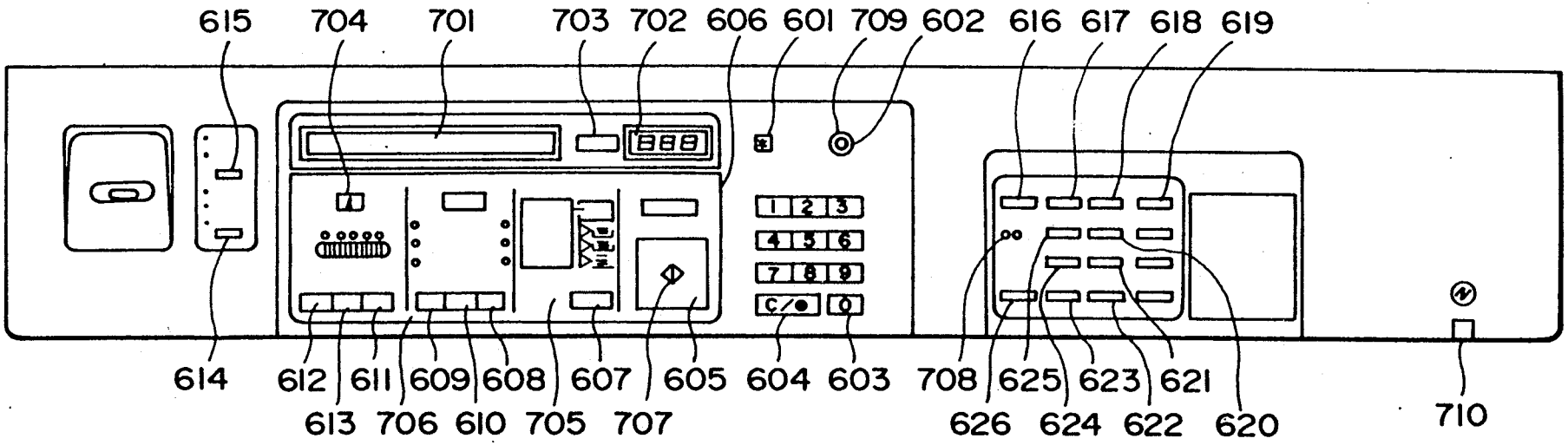
FIG. 3 is a top plan view of an operation panel of the apparatus according to an embodiment of the present invention.

FIG. 3 shows an example of an operation panel on the main assembly. The operation panel has a number of keys 600 and displays 700.

F. Keys (600)

In FIG. 3, a reference numeral 601 designates an asterisk (*) key which is used by the operator when a binding margin or the size of the original margin erasure are set. An all resetting key 606 is used to restore to a standard mode. A pre-heating key is pressed when the main assembly 100 is placed under the pre-heating state, and when the pre-heating state is reset. The key 602 is also pressed when the standard mode is restored from an automatic shut off state.

A copy start key 605 is pressed when the copying operation is to be started. A clear-stop key 604 functions as a clear key during the stand-by state, and also functions as a stop key when the copying or recording operation is performed. The clear key is pressed when the set number of copies is to be cleared. It is also used to escape from the asterisk mode.

The stop key is also pressed when the continuous copying operation is to be interrupted. If this is pressed, the copying operation being performed at that time is completed, and then, the copying operation is stopped.

Ten key 603 is pressed when the number of copies to be produced is set. It is also used to effect setting in the asterisk mode. A memory key 619 is used to register a mode which is frequently used by the operator. In this example, four registrations M1–M4 (four modes) are possible.

Copy density key 611 and 612 are manually operable to change the copy density. An AE key 613 is pressed when the copy density is automatically controlled in accordance with the density of the original, or when the manual density control mode is to be selected. A cassette selector key 607 is pressed when one of the upper cassette 151, an intermediate cassette 153 and the lower paper deck 201 are selected. When an original is placed on the document feeder 300, an APS (automatic cassette selection) can be selected by the key 607. When the APS mode is selected, the cassette having the copy sheets of the same size as the original is automatically selected. A unit magnification 610 is pressed when the copy having the same size as the original is to be produced. An automatic magnification changing key 616 is pressed when the size of the original is automatically reduced or enlarged in accordance with the size of the transfer sheet selected. A zoom keys 617 and 618 are pressed when a desired magnification is selected within arrange of 64–142%. Magnification changing keys 608 and 609 are used when predetermined magnifications are stored, and therefore, are used for the reaction and enlarge between fixed sizes.

A duplex key 626 is pressed when duplex copies are to be produced when a simplex original, or when the duplex copies are to be produced from duplex originals, or when a simplex copy is to be produced from duplex originals. A binding margin key 625 is used to provide a set length of binding margin at the left side of the transfer sheet. A photographic copy 624 is pressed when a photographic original is to be reproduced. An overlaying copy key 623 is pressed when a combined image is formed on one side of the transfer sheet from two originals.

An original margin erasure key 620 is used to erase the marginal edges of originals having predetermined sizes are to be erased, and the size of the original at this time is set by the asterisk key 601.

A sheet marginal edge erasing key 620 is used to erase the marginal portions on the basis of the size of the selected cassette.

A double copy key 622 is used when left and right pages of an original are to be copied on separate copy sheets.

A selector key 614 is used to select how to process the discharged sheet (stapling, sorting or grouping). When the image forming apparatus is connected with a stapler capable of stapling the recorded sheets, the stapling mode and sorting mode can be selected or disabled. When the sorter tray is connected, the sorting mode or the grouping mode is selectable.

A folding selector key 615 is used to fold and A3 sheet or B4 sheet in a usual (two fold) manner or in the form of Z.

G. Displays (700)

In FIG. 3, a message display 701 is made of LCD (liquid crystal). It displays various information relating to the copying operation. For example, one character is constituted by 5×7 dots, and it can displays 40 character message, and the copy magnification selected by the regular magnification changing keys 608 and 609, unit magnification key 610 or zoom keys 617 and 618. The display 701 is a semi-transparent type liquid crystal used with back lights of two colors. Usually a green back light is turned on, but when emergency state or the copy incapable state occurs, the back light of orange color is turned on.

A display 706 is a unit magnification display and is turned on when the unit magnification is selected. A color developing device display 703 is turned on when a sepia developing device is set in. A display 702 displays the number of copies to display the number of copies or a self diagnosis code. A display 705 displays the cassette being used out of the upper cassette 151, the intermediate cassette 153 and the bottom deck 201.

An AE (automatic exposure) display 704 is turned on when the automatic exposure (automatic density control) is selected by the AE key 613.

A pre-heating display 709 displays when the apparatus is under the pre-heating condition. Under the automatic shut off state, the display 709 is flickered. A ready/wait display 707 is made of two color LED elements (green and orange), and the green one is actuated in the ready state (copy operation is possible), and in the waiting state (copy is not possible), the orange one is turned on.

A duplex copy display 708 is turned on when a mode in which duplex copies are produced from duplex originals or a mode in which duplex copies are formed from simplex originals are selected.

When the recirculation type document feeder 300 is used in the standard mode, the number of copy is set to 1; the automatic exposure mode is selected; an automatic sheet selection mode is selected; the unit magnification is selected; and a mode for producing a simplex copy from a simplex original is selected.

In the standard mode without use of the document feeder 300, the number of copies is set to 1; manual density setting mode is selected; the unit magnification is selected; and a mode for producing a simplex copy is produced from a simplex original. The difference between the use of the document feeder 300 and the non-use thereof is determined on the basis of whether the original is set on the document feeder 300 or not.

A power source lamp 710 is turned on when a main switch is actuated.

In the foregoing embodiments, the means for changing the speed of the sorter unit may be in the form of pulse width modulation type wherein the ratio between on-period and the off-period of the motor driving pulse is controlled. However, other known methods such as phase locking loop control using a microprocessor or electric hardware, can be used.

In the foregoing embodiments, the CPU 501 is provided in the sheet sorter and receives from the main assembly a signal indicative of the sheet size, a signal indicative of the sheet discharge speed, a signal indicative of the sheet discharge interval and the like. However, the CPU may be disposed in the main assembly of the image forming apparatus, and the CPU may effect the calculation to obtain the speed of the sorter unit and may directly controls the motor for driving the sorter unit.

While the invention has been described with reference to the structures disclosed herein, it is not confined to the details set forth and this application is intended to cover such modifications or changes as may come within the purposes of the improvements or the scope of the following claims.

What is claimed is:

1. A control method for a sheet sorter comprising a plurality of sorting bins, discharging means for discharging sheets to the sort bins and driving means for moving the sort bins to present the sort bins to said discharging means, comprising:

moving a sorting bins at a first speed in association with receipt of the sheet by one of said sorting bins and moving the sorting bins at a second speed in association with a discharge interval between the sheets discharged by said discharging means, by controlling the driving means.

2. A method according to claim 1, wherein the first speed is maintained from a start of the sheet discharge to an end of the sheet discharge, and wherein the second speed is maintained from the end of the sheet discharge a start of a next sheet discharge.

3. A method according to claim 2, wherein the first speed is such that the sorting bin reaches a sheet non-receivable position upon completion of the sheet discharge, and wherein the second speed is such that the sorting bin reaches a sheet receivable position before the start of the next sheet discharge.

4. A method according to claim 3, wherein in the sheet non-receivable position, the sorting bin is above a path of the sheet discharged by said sheet discharging means, and wherein in said sheet receivable position, the sorting bin is below the path.

5. A method according to claim 1, wherein the first speed and the second speed are the same when a length of the sheet is equal to the discharge interval between the sheets.

6. A method according to claim 1, wherein the sorting bin is moved at a constant speed when a difference between the first speed and the second speed calculated is within a tolerance.

7. A method according to claim 1, wherein said sorting bins are moved substantially in the vertical direction, and wherein during their upward movement, the first speed and the second speed are selected, and the sorting bins are continuously moved upwardly, and wherein during downward movement, sorting bins are intermittently lowered.

8. A method according to claim 1, wherein said driving means includes a helical cam means rotatable and having helical groove, and the sorting bins are substantially vertically moved by one bin by rotation of said cam means.

9. A method according to claim 1, wherein the first speed is lower than the second speed when a length of the sheet is larger than the sheet interval, and wherein the first speed is higher than the second speed when the length of the sheet is smaller than the sheet interval.

10. A control method for an image forming apparatus with a sheet sorter comprising a plurality of sorting bins, discharging means for discharging sheets having images formed by said image forming apparatus to the sorting bins and driving means for moving the sort bins to present the sort bins to said discharging means, comprising:

moving the sorting bins at a first speed in association with receipt of a sheet by one of said sorting bins and moving the sorting bins at a second speed in association with a discharge interval between the sheets discharged by said discharging means, by controlling the driving means.

11. A sheet sorter comprising:

a plurality of sorting bins;

discharging means for discharging sheets to the sort bins;

driving means for moving the sorting bins to present the sorting bins to said discharging means; and control means for controlling said driving means to move the sorting bins at a first speed in association with receipt of a sheet by one of said sorting bins and to move the sorting bins at a second speed in association with a discharge interval between the sheets discharged by said discharging means.

12. An image forming apparatus, comprising:

means for forming images on sheets;

a plurality of sorting bins;

discharging means for discharging sheets having images formed by said image forming means to the sort bins;

driving means for moving the sorting bins to present the sorting bins to said discharging means; and control means for controlling said driving means to move the sorting bins at a first speed in association with receipt of a sheet by one of said sorting bins and to move the sorting bins at a second speed in association with a discharge interval between the sheets discharged by said discharging means.

* * * * *

UNITED STATES PATENT AND TRADEMARK OFFICE

CERTIFICATE OF CORRECTION

PATENT NO. : 5,042,793

DATED : August 27, 1991

INVENTOR(S) : Norifumi Miyake

It is certified that error appears in the above-identified patent and that said Letters Patent is hereby corrected as shown below: Title page:

[54] TITLE:

"SORTER" should read --SORTER AND--.

SHEET 12:

In Figure 12, "ITITIAL" should read --INITIAL--.

COLUMN 1:

Line 2, "SORTER" should read --SORTER AND--; and
Line 43, "portion" should be deleted.

COLUMN 2:

Line 24, "11C" should read --11B--;
Line 44, "(RDF)" should read --(RDF) 300--; and
Line 45, "sorter" should read --sorter 400--.

COLUMN 4:

Line 5, "passing" should read --passed--; and
Line 51, "end 420" should read --end 426--.

COLUMN 5:

Line 6, "i" should read --is--.

COLUMN 7:

Line 1, "signa" should read --signal--; and
Line 56, "the during" should read --while--.

UNITED STATES PATENT AND TRADEMARK OFFICE

CERTIFICATE OF CORRECTION

PATENT NO. : 5,042,793

DATED : August 27, 1991

INVENTOR(S) : Norifumi Miyake

It is certified that error appears in the above-identified patent and that said Letters Patent is hereby corrected as shown below:

COLUMN 8:

Line 60, "S611" should read --611--.

COLUMN 10:

Line 33, "operated to is" should read --is operated to--; and
Line 41, "weight 213" should read --weight 217--.

COLUMN 12:

Line 26, "A zoom" should read --Zoom--;
Line 30, "reaction" should read --reducing--;
Line 31, "enlarge" should read --enlarging--;
Line 33, "when" (first occurrence) should read --from--; and
Line 60, "and" should read --an--.

COLUMN 13:

Line 1, "selected" should read --is selected--.

UNITED STATES PATENT AND TRADEMARK OFFICE

CERTIFICATE OF CORRECTION

PATENT NO. : 5,042,793

DATED : August 27, 1991

INVENTOR(S) : Norifumi Miyake

It is certified that error appears in the above-identified patent and that said Letters Patent is hereby corrected as shown below:

COLUMN 14:

Line 6, "sort" should read --sorting--;
Line 7, "sort" should read --sorting-- (both occurrences);
Line 9, "a" (first occurrence) should read --the--;
Line 10, "the" should read --a--;
Line 18, "discharge" should read --discharge to--;
Line 44, "sorting" should read --the sorting--;
Line 60, "sort" should read --sorting--; and
Line 61, "sort" should read --sorting--;

COLUMN 15:

Line 3, "sort" should read --sorting--.

COLUMN 16:

Line 5, "sort" should read --sorting--.

Signed and Sealed this

Twelfth Day of May, 1992

*Attest:*

DOUGLAS B. COMER

*Attesting Officer*

*Acting Commissioner of Patents and Trademarks*